United States Patent [19]

Malish

[11] Patent Number: 4,536,912

[45] Date of Patent: Aug. 27, 1985

[54] COUPLER DEVICE FOR FLOOR MAINTENANCE PAD OR THE LIKE

[76] Inventor: Terrance J. Malish, 2520 Red Fox Pass, Willoughby, Ohio 44094

[21] Appl. No.: 550,942

[22] Filed: Nov. 14, 1983

[51] Int. Cl.[3] ..... A47L 11/14; A47L 11/40

[52] U.S. Cl. ..... 15/230.17; 15/257 R

[58] Field of Search ..... 15/230, 230.17, 230.19, 15/257 R; 51/358, 364, 376, 378

[56] References Cited

U.S. PATENT DOCUMENTS 2,032,249 2/1936 Bowen ..... 15/230.17

4,114,225 9/1978 Malish et al. ..... 15/230.17

*Primary Examiner*—Edward L. Roberts

*Attorney, Agent, or Firm*—Watts, Hoffmann, Fisher & Heinke Co.

[57] ABSTRACT

The present invention relates to floor maintenance machines and more particularly relates to a new and improved construction of a coupler device for centering and locking a floor maintenance pad, such as a cleaning, stripping, polishing or scrubbing pad, to a power-driven floor maintenance machine. The present invention has particular application for use with relatively high speed, heavy duty commercial and/or industrial type floor maintenance machines.

4 Claims, 6 Drawing Figures

COUPLER DEVICE FOR FLOOR MAINTENANCE PAD OR THE LIKE

TECHNICAL FIELD

The present invention relates to floor maintenance machines and more particularly relates to a new and improved construction of a coupler device for centering and locking a floor maintenance pad, such as a cleaning, stripping, polishing or scrubbing pad, to a power-driven floor maintenance machine. The present invention has particular application for use with relatively high speed, heavy duty commercial and/or industrial type floor maintenance machines.

RELATED PATENTS

The present invention relates to and constitutes a modification of applicant's prior mounting device disclosed in U.S. Pat. No. 4,114,225 filed on July 11, 1977 and issued on Sept. 19, 1978.

BACKGROUND OF THE INVENTION

As aforementioned, the present invention relates to a new and novel construction for what may be termed a coupler device for centering and detachably locking a floor maintenance pad to what it termed a pad holder. The pad holder is, in turn, detachably connected to the drive shaft of a power-driven floor maintenance machine of the type described in applicant's aforementioned U.S. Pat. No. 4,114,225. Such floor maintenance pads are generally of a circular configuration and made from a deformable and flexible material such as of a mesh or woven construction made from synthetic or natural fibers, steel wool or the like. Such pads are conventionally known in the art and have a predetermined density or porosity so as to provide the desired cleaning, stripping, polishing, scrubbing or other such floor maintenance application.

Heretofore, and as recognized in applicant's prior patent, there is a need to be able to maintain such pads in centered relation relative to the vertical axis of the drive shaft of the machine power source and to lock the pad in such centered relationship during relatively high speed operations especially in those situations where the machine is "heeled" back away from the surface to be treated such as when moving over or around an object (i.e. door threshold, corners, etc.) or when replacing the pad. Accordingly, continuing efforts have been made to improve the nature and quality of the centering and/or locking features of the coupler device while providing quick and easy installation and removal of the pad and without damage to the surface to be treated during use therof.

SUMMARY OF THE INVENTION

The present invention provides a coupler device adapted for detachable securement to a pad holder or other type of support means for centering and locking a floor maintenance pad to a power-driven floor maintenance machine. In the invention, the coupler device preferably includes a unitary body member made from a polymeric material including a generally cylindrical hub portion having an axial bore extending therethrough. The hub portion has a unitary base portion extending radially outwardly from one end thereof adapted for detachable securement to such pad holder or the like. The other end of the hub portion includes a unitary flange portion extending radially outwardly therefrom and generally parallel to said base portion. Said base and flange portions being axially spaced apart a distance sufficient to slidably receive therebetween the corresponding transverse thickness of a maintenance pad. The hub portion mounts a plurality of generally radially extending tine elements having axial lengths sufficient to engagably penetrate within the material of the pad for centering and detachably locking the same relative to said hub portion. In the invention, the flange portion has one maximum transverse dimension greater than the corresponding transverse dimension of the center hole in the pad and has another minimum transverse dimension less than the aforementioned corresponding maximum transverse dimension of said flange portion.

By the foregoing construction, there is provided a coupling device which enables the pad to be quickly and easily installed and/or removed relative to the hub portion for detachably locking securement via the flange portion to the pad holder. The radially extending tine elements coact, by a friction penetrating engagement, with the material of the pad to enable the pad to be centered in generally concentric relation relative to the longitudinal rotational axis of the pad relative to the floor machine. This construction is of a simple yet unitary rugged construction. The coupler device can be fabricated relatively inexpensively from a polymeric material and provides light-weight and yet high strength characteristics to the coupler device.

Other advantages and objects of the invention will become apparent as the following description proceeds when taken in conjunction with the accompanying drawings.

BEST MODE FOR CARRYING OUT THE INVENTION

Figure 1:
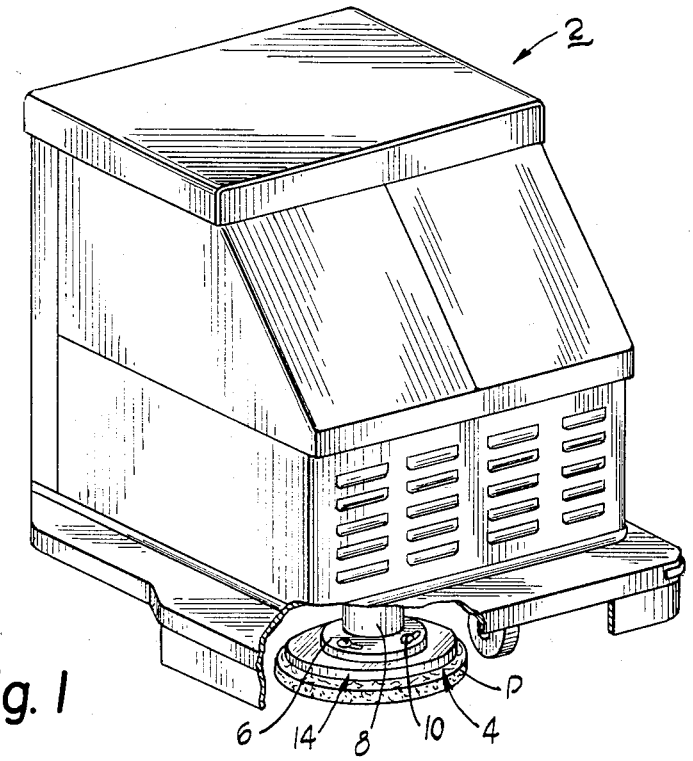
FIG. 1 is a fragmentary, generally perspective view of one form of the coupler device of the invention illustrated for use with a commercial, multi-brush scrubber apparatus.
Figure 2:
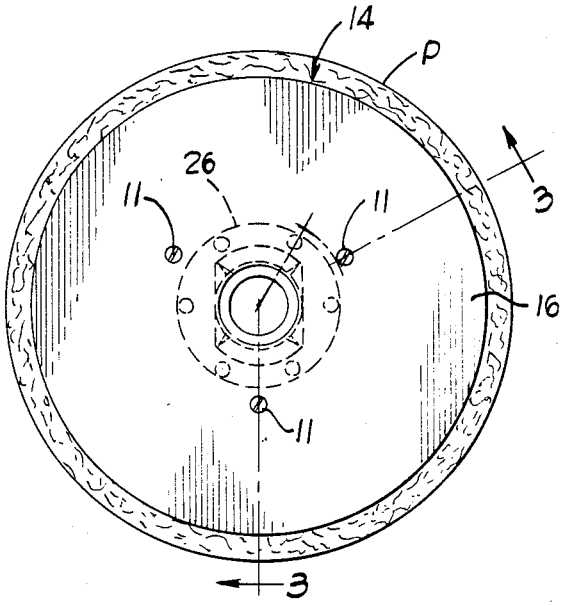
FIG. 2 is a top plan view of the coupler device and floor maintenance pad in the invention.

Referring again to the drawings, in particular to FIG. 1 thereof, there is generally illustrated a cleaning machine, designated generally at 2, such as an automatic scrubber. As recognized in the art, such scrubber includes a plurality of spindles for detachably mounting a corresponding number of brushes or pad holders. In the present invention, there is provided a new and novel construction for a coupler device, designated generally at 4, which is detachably connected via a conventional type mounting plate 6 that, in turn, forms an integral part of the drive spindle 8 of the scrubber. The plate 6 is also provided with a conventional type key-way slot arrangement 10 for detachably connecting the pad holder to the spindle. As aforementioned, this illustrates generally one form of the invention which is especially suitable for use with a multi-brush scrubber machine and or with a single brush-type machine. Preferably, the mounting device of the invention has particular application in relation to multi-type scrubber machines were ease of interchangeability of the individual brushes for replacement is of primary importance.

Figure 3:
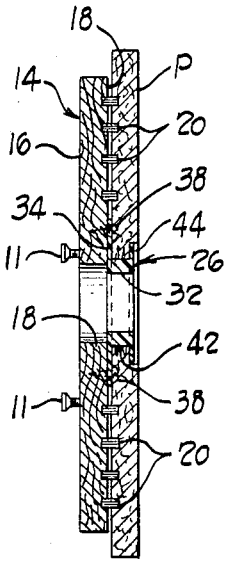
FIG. 3 is a horizontal section view taken on the line 3—3 of FIG. 2.
Figure 4:
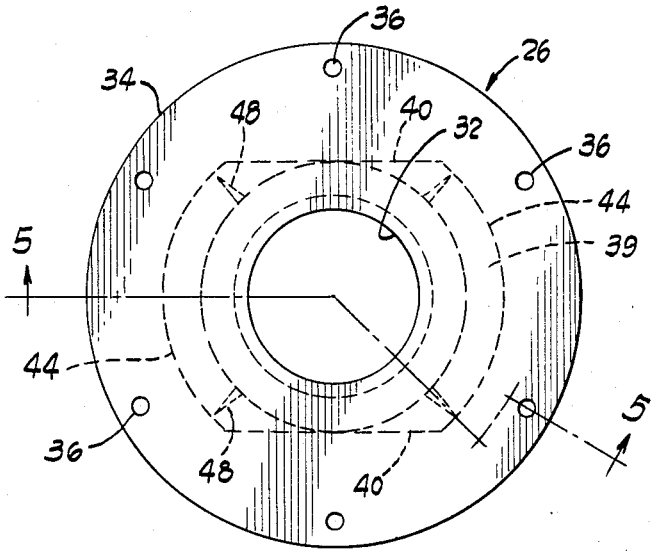
FIG. 4 is a top plan view of the coupler device made in accordance with the invention.

As illustrated in FIGS. 3 and 4, the mounting system of the present invention includes a pad holder or support block 14 which may be made of wood or the like having generally flat surfaces 16 and 18 defining a generally circular configuration. The block 14 has a central hole 18 extending therethrough to accommodate the detachable connection with the machine spindle 8. The block 14 may be provided with suitable fasteners, as at 11, for detachable connection with the key-way slots 10 provided in the support plate 6. The block 14 may be provided with a plurality of symmetrically oriented filaments and/or filament bundles that may be resilient or rigid, designated generally at 20, disposed to provide effective mechanical gripping coacting engagement with the material of the pad element P, such as for cleaning, stripping, scrubbing, polishing, or the like. Such filament construction is more fully described in applicants of aforementioned U.S. Pat. No. 4,114,225.

Now in the invention, the coupler device, designated generally at 26, is of a unitary construction including a central, circular hub portion 28 defined by an endless circular surface 30 (FIG. 5) having a central bore 32 extending therethrough. On the one end of the hub there is provided a unitary base portion 34 of a flat circular construction having apertures, as at 36, for detachable connection via fasteners, as at 38 (FIG. 3), to the support block 14. The other end of the hub portion 28 is provided with a unitary flange portion 39 of generally circular construction but which has flat portions, as at 40, on opposed sides thereof. The flange portion 39 is disposed in laterally spaced, parallel relationship to the base portion 34 and is laterally spaced a distance therefrom sufficient to receive therebetween the corresponding cross-sectional thickness of the pad element P. In the invention, the flange portion 39 has a substantially reduced diameter compared to that of the base portion 34 and is concentrically oriented with respect thereto. The maximum transverse dimension of the flange portion 39 is greater than the corresponding maximum transverse dimension of the hole 42 (FIG. 3) provided in the pad element P with the flat portions 40 providing a reduced transverse dimension therebetween relative to the aforementioned maximum transverse dimension of the flange portion. By this arrangement, the material of hole 42 of the pad element can be stretched over and around the flange portion 39 because of the reduced dimension of the flat portions 40 thereby to provide a snug-fit of the central hole 42 in the pad element P relative to the flange portion 39 such that, in the installed position, the arcuate portions, as at 44, of the flange portions 39 overlie the confronting marginal edge of the central hole 42 in the pad element P. That is to say, the reduced transverse dimension provided by the flat portions 40 enables the material of the pad element P to stretch over, around and under the arcuate portions 44 of the flange 39.

Figure 5:
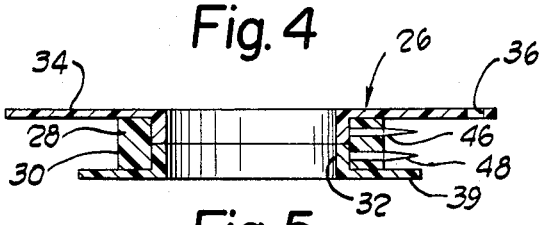
FIG. 5 is a horizontal section view taken along the line 5—5 of FIG. 4.
Figure 6:
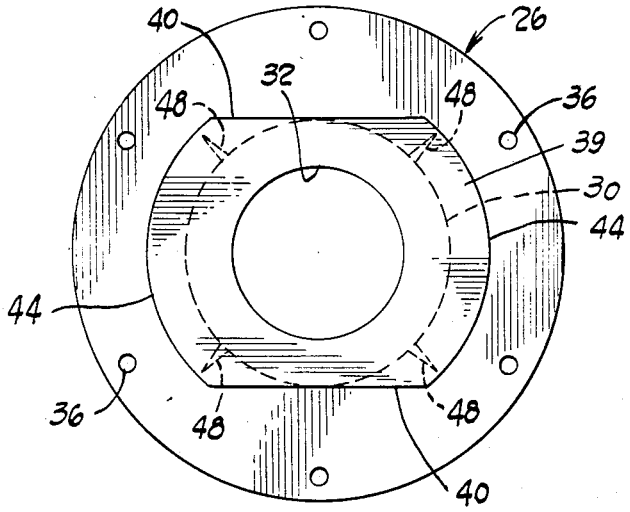
FIG. 6 is a bottom view of the coupler device illustrated in FIG. 4.

Now in accordance with the invention, the hub portion 28 is provided with a plurality of radially extending tine elements 46 which taper into a pointed end, as at 48, for frictional penetrating engagement interiorly of the material of the pad element P. These tine elements serve as retaining elements to prevent rotational movement of the pad element relative to the hub portion 28 and hence, relative to the support block 14. In the embodiment shown, there is illustrated four sets of tine elements disposed approximately 90° apart with each set of tine elements including a pair of superposed tine elements. Preferrably, the tine elements, have a length generally co-terminous with the peripheral edge (FIG. 6) of the arcuate portions 44 and are preferrably disposed generally parallel to one another and generally parallel to the horizontal plane of the base 34 and flange 39 portions. As best illustrated in FIG. 5, the tine elements 46 are disposed in generally equispaced relationship between the base and flange portions 34 and 39 and underlie the base portion 34.

In the invention, the tine elements 46 are preferrably made unitary with the hub portion 28 but may be fabricated separately and then fixedly attached to the hub portion.

The tine elements, in the embodiment illustrated, may be of any suitable configuration so long as their terminal ends act to provide a penetrating action in respect to the pad material so as to frictionally restrain the pad against rotational movement relative to the pad holder or support block. As shown, the tine elements are preferrably tapered so as to terminate in relatively sharp pointed ends. In the invention, the tine elements are preferrably made unitary with the hub portion and hence, when the hub portion is made from a polymeric (plastic) material so also may the tine elements be made from such material. In this form, tine elements are generally of a rigid construction and may also, for example, be made from a metallic material (i.e. stainless steel or the like) or may be made from a bundle of individual bristles or filaments so as to provide a generally overall rigid retention construction. Also, in the invention it will be understood that the tine elements whether they be in the form or individual structural components and/or in the form of bundles may be oriented in any desired pattern in respect to the outer peripheral surface of the hub portion. That is, one could have four sets of two tine elements each, as shown, or one might have three sets of two tine elements each or simply three tine elements disposed equi-distantly around the periphery of the hub portion. Further, it will be understood that the tine elements can be preassembled with a polymeric ring or sleeve member. That is, in turn, secured (by adhesives or the like) to the confronting outer surface of the hub portion thereby to provide the unitary structure, as desired. Still further, it will be understood that the tine elements may be made of one material (i.e. metal) and the hub portion of another material (i.e. plastic) to provide a composite, unitary structure.

Accordingly, while the foregoing have been described as the best and alternate modes for carrying out the invention it would be appreciated that other modifications of the invention are contemplated within the following claims.

I claim:

1. A coupler device of the type for detachably mounting a floor maintenance pad, such as for cleaning, stripping, polishing, scrubbing or the like, to a pad holder member for use with a floor maintenance machine, said coupler device comprising a unitary body member defining a centrally disposed hub portion for centering said pad relative to said pad holder, said hub portion having a base portion extending radially outwardly at one end and adapted for detachable securement to said pad holder member, said hub portion including at its other end a radially extending flange portion with said base and flange portions being laterally spaced apart a distance sufficient to accommodate the transverse thickness of said maintenance pad therebetween, and said hub portion including a plurality of tine elements extending radially therefrom and disposed for penetrating frictioaal coacting engagement with the material of said maintenance pad to restrain rotational movement of said maintenance pad relative to said pad holder and to frictionally center and lock said pad relative to said pad holder during usage of said floor maintenance machine, wherein said flange portion includes arcuate and flat portions defining a maximum transverse dimension which is greater than a central opening formed in said maintenance pad and a minimum transverse dimension that is less than said maximum transverse dimension to facilitate installation of said maintenance pad relative to said hub portion whereby outer peripheral edge portions of said flange portion are disposed in overlieing relationship relative to the corresponding inner peripheral edge defined by the hole in said maintenance pad.

2. A coupler device of the type for detachably mounting a floor maintenance pad, such as for cleaning, stripping, polishing, scrubbing or the like, to a pad holder member for use with a floor maintenance machine, said coupler device comprising a unitary body member defining a centrally disposed hub portion for centering said pad relative to said pad holder, said hub portion having a base portion extending radially outwardly at one end and adapted for detachable securement to said pad holder member, said hub portion including at its other end a radially extending flange portion with said base and flange portions being laterally spaced apart a distance sufficient to accommodate the transverse thickness of said maintenance pad therebetween, and said hub portion including a plurality of tine elements extending radially therefrom and disposed for penetrating frictional coacting engagement with the material of said maintenance pad to restrain rotational movement of said maintenance pad relative to said pad holder and to frictionally center and lock said pad relative to said pad holder during usage of said floor maintenance machine, wherein said base and flange portions extend generally parallel to one another, said flange portion having a maximum transverse dimension in one direction greater than the corresponding maximum transverse dimension of a centering hole formed in said maintenance pad and having a minimum transverse dimension in another direction which is less than said first mentioned maximum transverse dimension of said flange portion to facilitate stretching the material of said maintenance pad over and around said flange portion and into engaged relation with the tine elements extending from said hub portion.

3. A coupler device in accordance with claim 2, wherein said maintenance pad has a centrally disposed hole formed therein and having a diameter which is less than the maximum transverse dimension of said flange portion, said hub portion defining a hollow cylindrical bore having an internal diameter less than the diameter of the hole in said maintenance pad, and said hub portion having an external diameter slightly greater than the hole in said maintenance pad.

4. A coupler device in accordance with claim 2, wherein said body member is made from a rigid polymeric material and said tine elements are made from a metallic material.

* * * * *